US006564788B1

(12) United States Patent
Hu

(10) Patent No.: US 6,564,788 B1
(45) Date of Patent: May 20, 2003

(54) MOTORIZED TOY GUN

(76) Inventor: Shih-Che Hu, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/012,153

(22) Filed: Nov. 29, 2001

(51) Int. Cl.[7] ..... F41B 11/00
(52) U.S. Cl. ..... 124/66; 124/31
(58) Field of Search ..... 124/63–69, 31, 124/32, 41.1; 42/39.5, 41, 42.01; 446/399–401, 406, 473

(56) References Cited

U.S. PATENT DOCUMENTS 1,065,556 A * 6/1913 Searle ..... 124/67
1,760,652 A * 5/1930 Loomis ..... 124/67
3,370,581 A * 2/1968 Hills et al. ..... 124/67
3,951,038 A * 4/1976 Van Langenhoven ..... 89/7
4,114,311 A * 9/1978 Chow ..... 446/406
5,261,384 A * 11/1993 Hu ..... 124/66
5,323,755 A * 6/1994 Hsieh ..... 124/66
5,531,210 A * 7/1996 Meiser et al. ..... 124/66
5,611,321 A * 3/1997 Hoeting et al. ..... 124/6
6,302,092 B1 * 10/2001 Juan ..... 124/31
2002/0166551 A1 * 11/2002 Lee ..... 124/78

* cited by examiner

*Primary Examiner*—Peter M. Poon
*Assistant Examiner*—Susan L. Piascik

(57) ABSTRACT

The present invention relates to a motorized toy gun including a bullet feeding device, a power set, and a trigger operation set. The power set includes a motor, a first drive gear, a second drive gear, and a force output gear. The trigger operation set includes a trigger, a connecting arm push plate, a trigger arm, a lift member, a connecting arm, a switch arm, a locking member, and a microswitch. Thus, forward movement of the piston cylinder may be accelerated by the restoring force of the piston spring and by a power provided by the force output gear and the rack, thereby increasing the pressure in the cylinder, so that the BB bullet may be ejected outward quickly.

8 Claims, 10 Drawing Sheets

MOTORIZED TOY GUN

BACKGROUND OF THE INVENTION

1. Field of the Invention

The present invention relates to a motorized toy gun, and more particularly to a motorized toy gun, wherein the horizontal forward movement of the piston cylinder may be accelerated by the restoring force of the piston spring and by the power provided by the force output gear co-operating with the rack, thereby greatly increasing the pressure in the cylinder, so that the BB bullet may be ejected outward quickly and conveniently.

2. Description of the Related Art

A conventional motorized toy gun in accordance with the prior art comprises a power set whose power is supplied by batteries. The power set includes a motor co-operating with multiple gears, and the power supplied by the motor may be transmitted by an output shaft, thereby ejecting the BB bullet outward. However, the gears of the power set will bear load at a normal state due to the torque of the output shaft, thereby decreasing the lifetime of gears of the power set during long-term utilization.

SUMMARY OF THE INVENTION

The present invention has arisen to mitigate and/or obviate the disadvantage of the conventional motorized toy gun.

The primary objective of the present invention is to provide a motorized toy gun, wherein the horizontal forward movement of the piston cylinder may be accelerated by the restoring force of the piston spring and by the power provided by the force output gear co-operating with the rack, thereby greatly increasing the pressure in the cylinder, so that the BB bullet may be ejected outward quickly and conveniently.

Another objective of the present invention is to provide a motorized toy gun, wherein the locking lug of the locking member may be locked with the locking recess of the piston cylinder, so that the force output gear and the rack will not bear any load at a normal state, thereby saving the power source.

A further objective of the present invention is to provide a motorized toy gun, wherein the piston cylinder may be moved in the cylinder freely, the force output gear may mesh with and detach from the rack easily, and the microswitch may be opened by the switch arm.

A further objective of the present invention is to provide a motorized toy gun, wherein the force output gear will not mesh with the rack in a normal state, thereby decreasing the load of the motor, and thereby increasing the lifetime of the toy gun.

A further objective of the present invention is to provide a motorized toy gun, wherein the trigger may be pressed continuously, whereby the resting block insertion recess of the connecting arm is rested on the connecting arm resting block of the lift member, so that the switch arm may connect the electric power successively, so that the BB bullet may be ejected outward continuously.

In accordance with the present invention, there is provided a motorized toy gun, comprising:

a gun body provided with a barrel having an inner portion provided with a bullet feeding device that may be moved and operated horizontally, the barrel of the gun body having a lower portion provided with a power set and a trigger operation set, and having a front end provided with a BB bullet supply portion which has a center formed with a transverse hole, a cocking handle mounted on an upper portion of the BB bullet supply portion to move horizontally, the transverse hole of the BB bullet supply portion having a mediate section provided with a bullet feeding chamber whose inner portion is provided with a pressure applying portion, and a front section provided with a bullet outlet tube;

the bullet feeding device including a cylinder, a piston cylinder, a front spring guide tube, a piston spring, a rear spring guide tube, a nozzle, a sealing tube, and a bullet feeding spring;

the power set including a motor, a first drive gear, a second drive gear, and a force output gear, wherein:

the piston cylinder has an outer wall having a lower portion formed with a locking recess, an inclined path beside the locking recess, and a rack beside the inclined path;

the force output gear of the power set has multiple teeth arranged in a sector shape, and has a center provided with an idler which has an insertion recess;

the trigger operation set includes a trigger, a connecting arm push plate, a trigger arm, a lift member, a connecting arm, a switch arm, a locking member, and a microswitch;

the trigger has a top end having a first side pivoted with a front end of the trigger arm, and a second side formed with an arcuate recess, the trigger has a mediate section pivoted with a front end of the connecting arm push plate, the connecting arm push plate has a mediate section formed with a lug insertion hole, the trigger arm has a rear end pivoted with a lower end of the lift member, the lower end of the lift member has an arcuate portion received in the arcuate recess of the trigger, the lower end of the lift member has a wall protruded with a connecting arm resting block, the lift member has an upper end provided with an upper resting block and a side resting block, the connecting arm has a lower end pivoted above the connecting arm push plate, and provided with a lug that may be inserted into the lug insertion hole of the connecting arm push plate, the connecting arm has an upper end formed with a resting block insertion recess for receiving the connecting arm resting block of the lift member, the switch arm may be moved horizontally, and has a rear end provided with an idler push portion, a mediate section provided with a push action block, and a front end provided with an inclined press face, the microswitch is mounted under the front end of the switch arm, and includes a press button that may be pressed by the inclined press face of the switch arm, the locking member is pivoted above the push action block of the switch arm, and has an upper end provided with a locking lug, a side portion provided with a first driven portion and a second driven portion, and a lower end provided with a drive block.

Further benefits and advantages of the present invention will become apparent after a careful reading of the detailed description with appropriate reference to the accompanying drawings.

BRIEF DESCRIPTION OF THE DRAWINGS

FIG. 1-1 is a plan view of a trigger operation set of the motorized toy gun in accordance with a first embodiment of the present invention;

FIG. 2-1 is a schematic operational view of the motorized toy gun as shown in FIG. 1-1 in use;

FIG. 3-1 is a schematic operational view of the motorized toy gun as shown in FIG. 2-1 in use;

FIG. 4-1 is a schematic operational view of the motorized toy gun as shown in FIG. 3-1 in use;

DETAILED DESCRIPTION OF THE INVENTION

Figure 1:
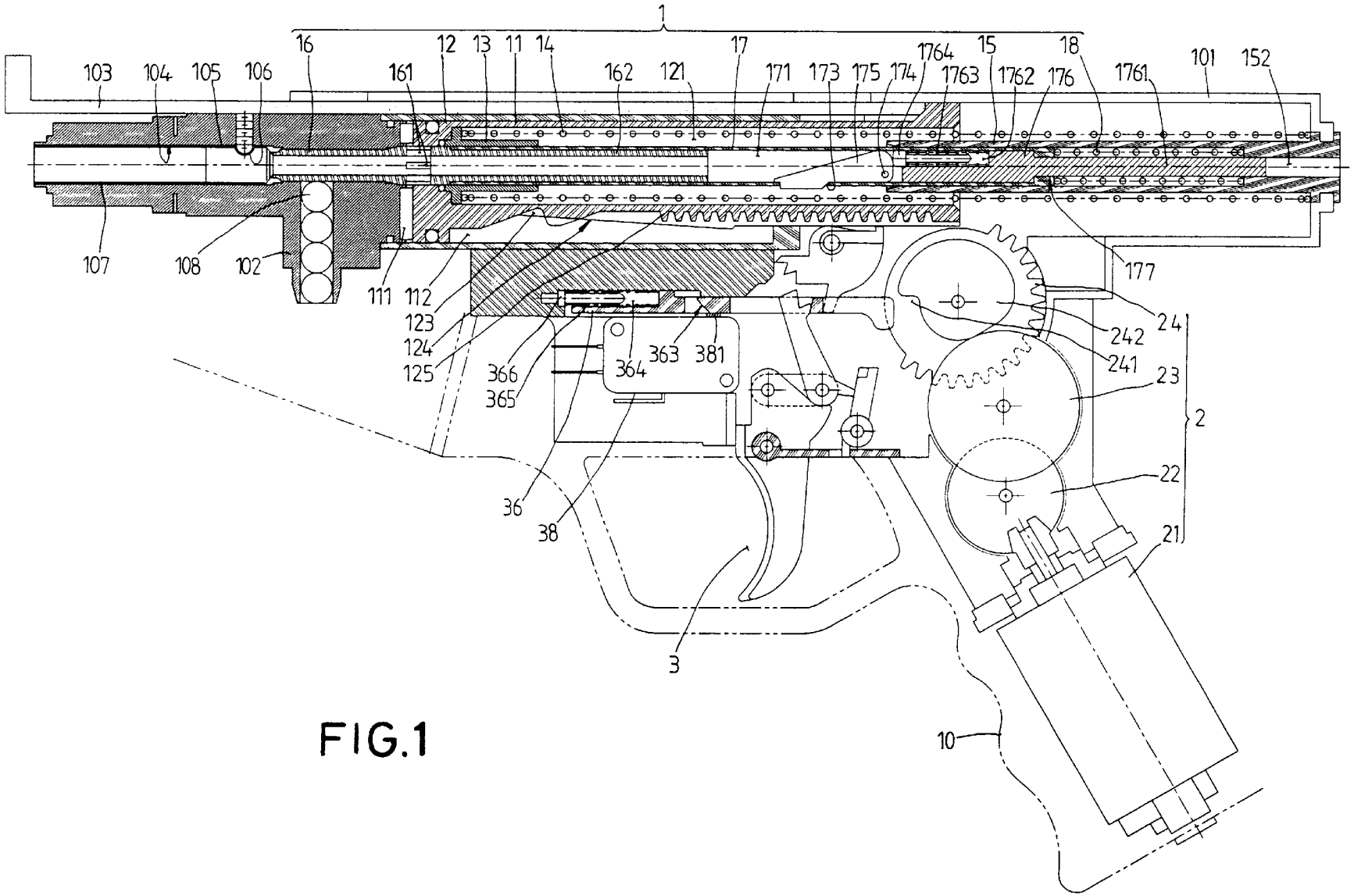
FIG. 1 is a front plan cross-sectional assembly view of a motorized toy gun in accordance with a first embodiment of the present invention.
Figure 1:
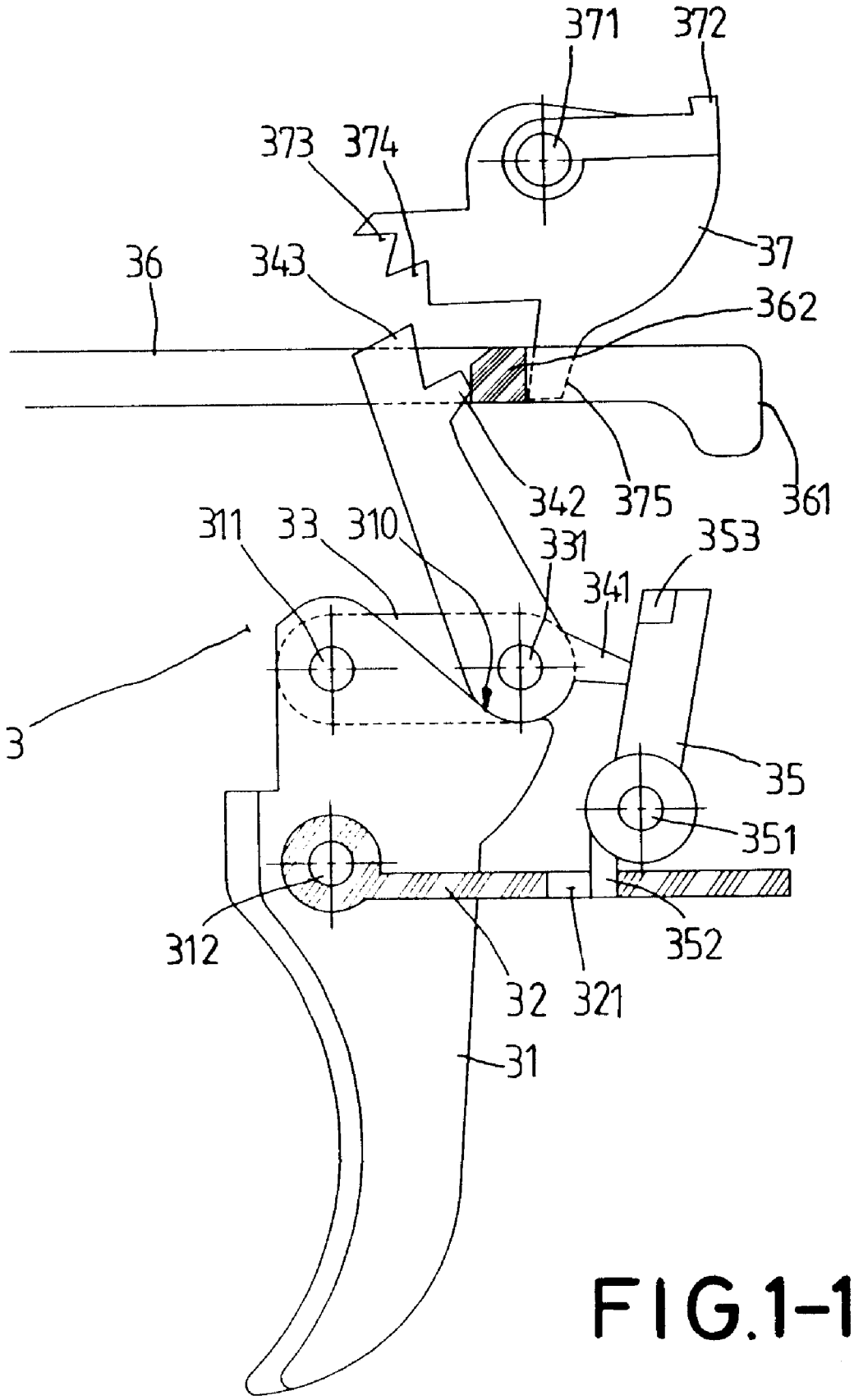

Referring to the drawings and initially to FIG. 1, a motorized toy gun in accordance with a first embodiment of the present invention comprises a gun body 10 provided with a barrel 101 having an inner portion provided with a bullet feeding device 1 that may be moved and operated horizontally. The barrel 101 of the gun body 10 has a lower portion provided with a power set 2 and a trigger operation set 3, and has a front end provided with a BB bullet supply portion 102 which has a center formed with a transverse hole 104. A cocking handle 103 is mounted on an upper portion of the BB bullet supply portion 102 to move horizontally. The BB bullets 108 may be pushed upward in the BB bullet supply portion 102. The transverse hole 104 of the BB bullet supply portion 102 includes a mediate section provided with a bullet feeding chamber 105 whose inner portion is provided with a pressure applying portion 106, and a front section provided with a bullet outlet tube 107.

The bullet feeding device 1 includes a cylinder 11, a piston cylinder 12, a front spring guide tube 13, a piston spring 14, a rear spring guide tube 15, a nozzle 16, a sealing tube 17, and a bullet feeding spring 18.

The cylinder 11 is secured on a rear portion of the BB bullet supply portion 102, and has an inner portion divided by a front section of the piston cylinder 12 into a left air chamber 111 and a right air chamber 112.

The piston cylinder 12 is movable in the cylinder 11, and has an inner portion formed with a U-shaped receiving chamber 121. The piston cylinder 12 has a front end received in the cylinder 11, and a rear end extended outward from a rear portion of the cylinder 11 and formed with a piston push portion 122 rested on a distal end of the cocking handle 103. The piston cylinder 12 has an outer wall having a lower portion formed with a locking recess 123, an inclined path 124 beside the locking recess 123, and a rack 125 beside the inclined path 124.

The front spring guide tube 13 is secured in a front end of the receiving chamber 121 of the piston cylinder 12, to horizontally move with the piston cylinder 12 simultaneously.

The piston spring 14 may be compressed and extended, and has a front end mounted on an outer wall of the front spring guide tube 13.

The rear spring guide tube 15 has a front end extended into a rear end of the receiving chamber 121 of the piston cylinder 12, and has a rear end secured to a distal end of the barrel 101. The piston spring 14 has a rear end mounted on an outer wall of the rear spring guide tube 15. The rear spring guide tube 15 has an inner portion including a front section formed with a spring receiving chamber 151 and a rear section formed with a guide rod through hole 152.

The nozzle 16 is a hollow cylinder, and has a front section received in a rear section of the transverse hole 104 of the BB bullet supply portion 102, a mediate section formed with multiple air collection ports 161, and a rear section formed with an insertion section 162.

The sealing tube 17 is formed with a U-shaped receiving space 171, and has a front section extended through a center of the front spring guide tube 13 and secured on the insertion section 162 of the nozzle 16. The sealing tube 17 has a rear section received in the spring receiving chamber 151 of the rear spring guide tube 15. The receiving space 171 of the sealing tube 17 has a front section that may receive and position the insertion section 162 of the nozzle 16. The receiving space 171 of the sealing tube 17 has a mediate section having a lower portion formed with a through hole 173. A locking hook 175 is pivoted in the receiving space 171 of the sealing tube 17 by a hook bolt 174. A T-shaped guide rod 176 is received in a rear section of the receiving space 171 of the sealing tube 17, and has an extension section 1761 extended outward from a through hole 177 formed in a rear end of the sealing tube 17. The extension section 1761 has a rear end received in the guide rod through hole 152 of the rear spring guide tube 15. The guide rod 176 has a front section formed with a spring receiving chamber 1762 for receiving a hook push spring 1763, and a hook push member 1764. The hook push member 1764 has a front end face rested on a rear end face of the locking hook 175.

The bullet feeding spring 18 is mounted on an outer wall of the extension section 1761 of the sealing tube 17, and received in the spring receiving chamber 151 of the rear spring guide tube 15.

The power set 2 includes a motor 21, a first drive gear 22, a second drive gear 23, and a force output gear 24. The force output gear 24 has multiple teeth arranged in a sector shape, and has a center provided with an idler 242 which has an insertion recess 241.

Referring to FIGS. 1 and 1-1, the trigger operation set 3 includes a trigger 31, a connecting arm push plate 32, a trigger arm 33, a lift member 34, a connecting arm 35, a switch arm 36, a locking member 37, and a microswitch 38.

The trigger 31 has a top end having a first side pivoted with a front end of the trigger arm 33 by a pivot axle 311, and a second side formed with an arcuate recess 310. The trigger 31 has a mediate section pivoted with a front end of the connecting arm push plate 32 by a pivot axle 312. The connecting arm push plate 32 has a mediate section formed with a lug insertion hole 321. The trigger arm 33 has a rear end pivoted with a lower end of the lift member 34 by a pivot axle 331. The lower end of the lift member 34 has an arcuate portion received in the arcuate recess 310 of the trigger 31. The lower end of the lift member 34 has a wall protruded with a connecting arm resting block 341. The lift member 34 has an upper end provided with an upper resting block 342 and a side resting block 343. The connecting arm 35 has a lower end pivoted above the connecting arm push plate 32 by a pivot axle 351, and provided with a lug 352 that may be inserted into the lug insertion hole 321 of the connecting arm push plate 32. The connecting arm 35 has an upper end formed with a resting block insertion recess 353 for receiving the connecting arm resting block 341 of the lift member 34.

The switch arm 36 may be moved horizontally, and has a rear end provided with an idler push portion 361, a mediate section provided with a push action block 362, and a front end provided with an inclined press face 363. The microswitch 38 is mounted under the front end of the switch arm 36, and includes a press button 381 that may be pressed by the inclined press face 363 of the switch arm 36. The front end of the switch arm 36 is formed with a receiving recess 364 for receiving a push arm spring 365 and a mounting rod 366.

The locking member 37 is pivoted above the push action block 362 of the switch arm 36 by a pivot axle 371, and has an upper end provided with a locking lug 372, a side portion provided with a first driven portion 373 and a second driven portion 374, and a lower end provided with a drive block 375.

In operation, the cocking handle 103 may be pushed toward the rear portion of the barrel 101. The piston push portion 122 of the piston cylinder 12 of the bullet feeding device 1 is rested on the distal end of the cocking handle 103 so that the piston cylinder 12 may be moved rearward with the cocking handle 103 simultaneously, and the nozzle 16 and the sealing tube 17 may be moved rearward with the piston cylinder 12 simultaneously. Thus, the front end of the nozzle 16 is detached from the top of the BB bullet supply portion 102, so that the BB bullet 108 may be pushed by an upward elastic force to enter the transverse hole 104.

Figure 2:
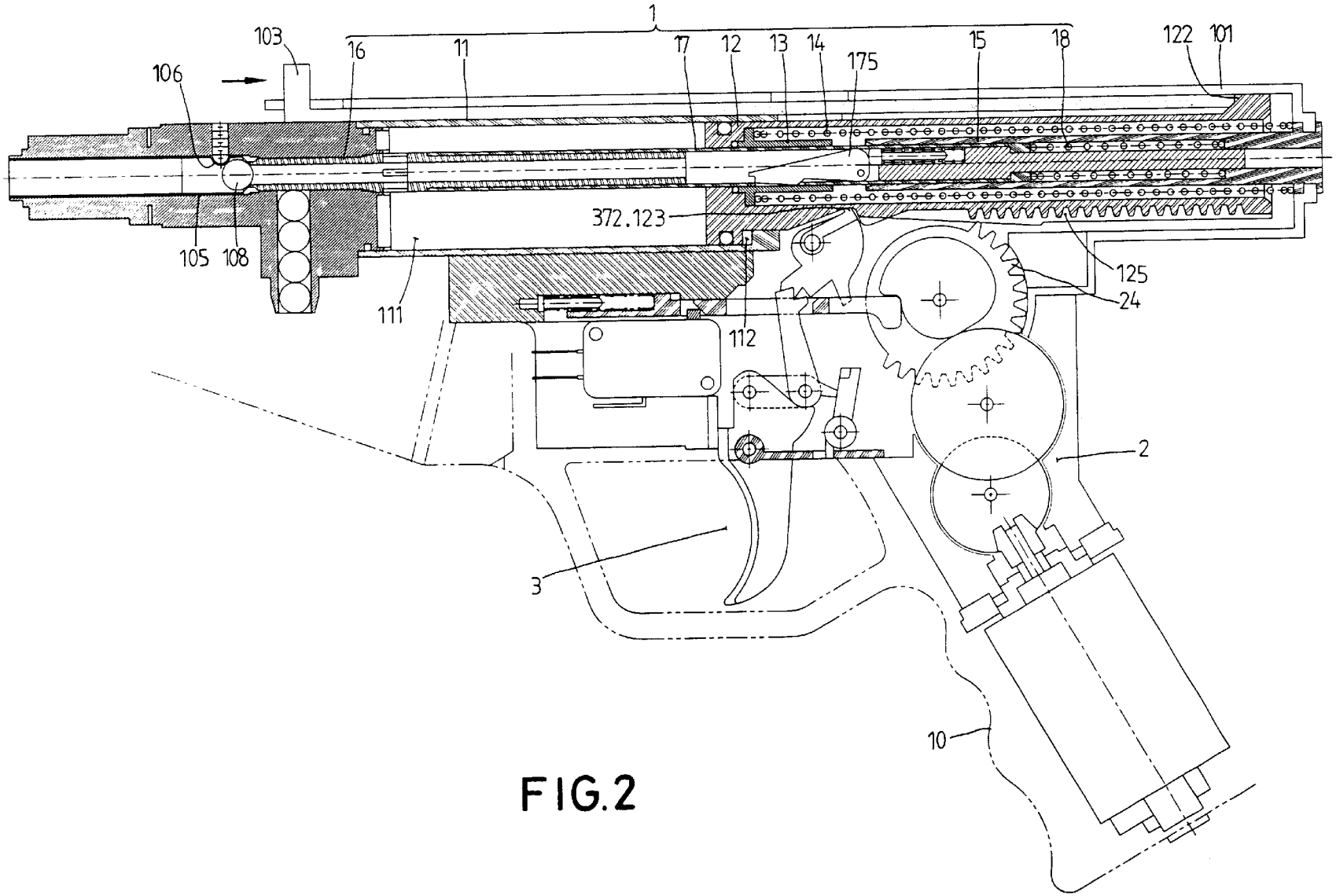
FIG. 2 is a schematic operational view of the motorized toy gun as shown in FIG. 1 in use.
Figures 1, 2:
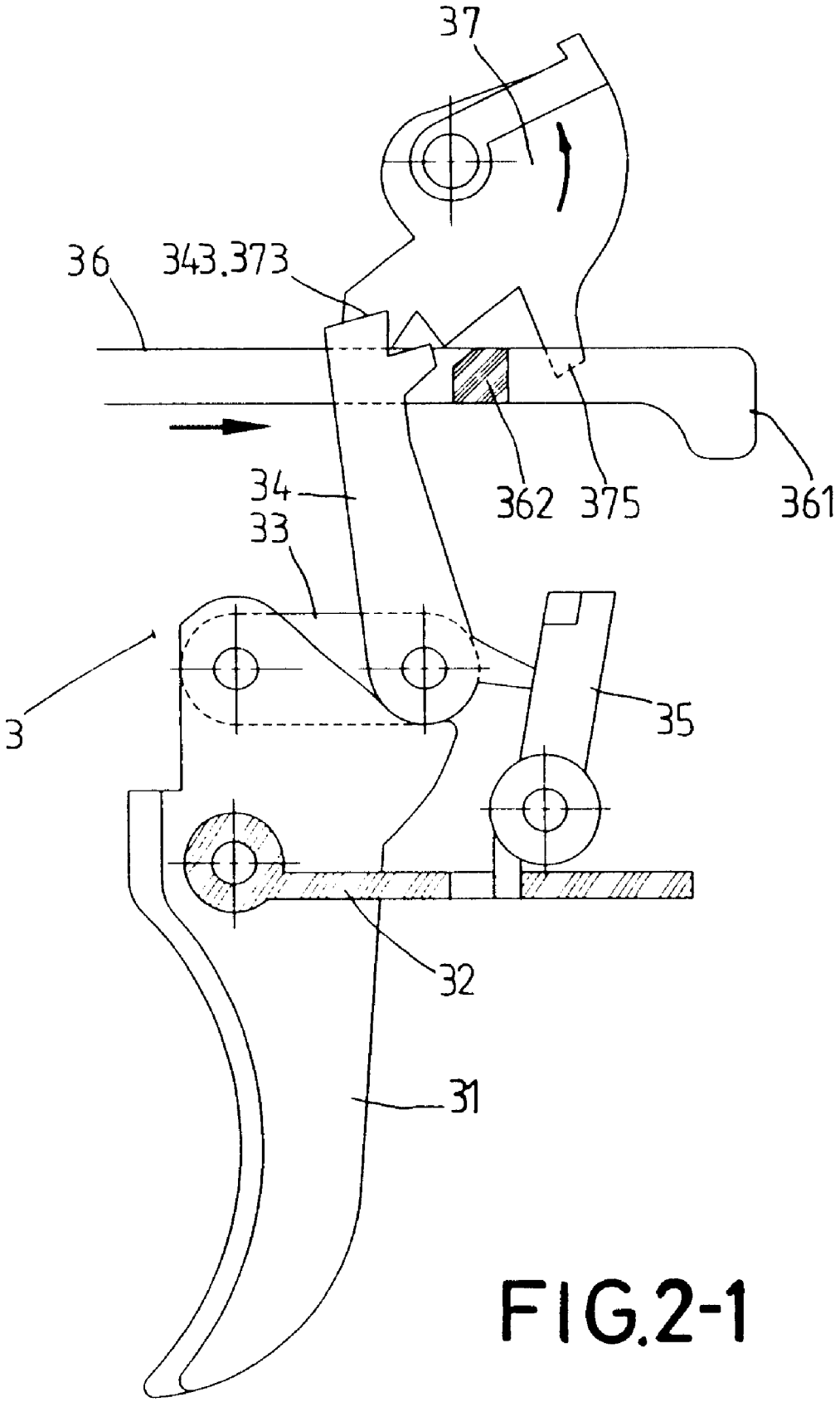

When the sealing tube 17 is moved rearward, the locking hook 175 of the sealing tube 17 is lifted by an inclined face of the rear spring guide tube 15, to detach from the through hole 173 of the sealing tube 17, so that the sealing tube 17 and the nozzle 16 may be pushed forward by the restoring force of the bullet feeding spring 18, to push the BB bullet 108 in the transverse hole 104 to reach the position of the pressure applying portion 106 of the bullet feeding chamber 105 as shown in FIG. 2.

Thus, the single-stroke horizontal movement of the piston cylinder 12 may force the BB bullet 108 to reach the position of the pressure applying portion 106 of the bullet feeding chamber 105 as shown in FIG. 2, to be ready for shooting. At this time, the locking lug 372 of the locking member 37 may enter the locking recess 123 of the piston cylinder 12, and the drive block 375 is moved with the counterclockwise rotated locking member 37 to detach from the push action block 362 of the switch arm 36 as shown in FIG. 2-1, so that the switch arm 36 may be pushed rearward by the restoring force of the push arm spring 365, and the idler push portion 361 of the switch arm 36 may be inserted into the insertion recess 241 of the idler 242 of the force output gear 24. At this time, the press button 381 of the microswitch 38 is disposed at a closed state.

Figure 3:
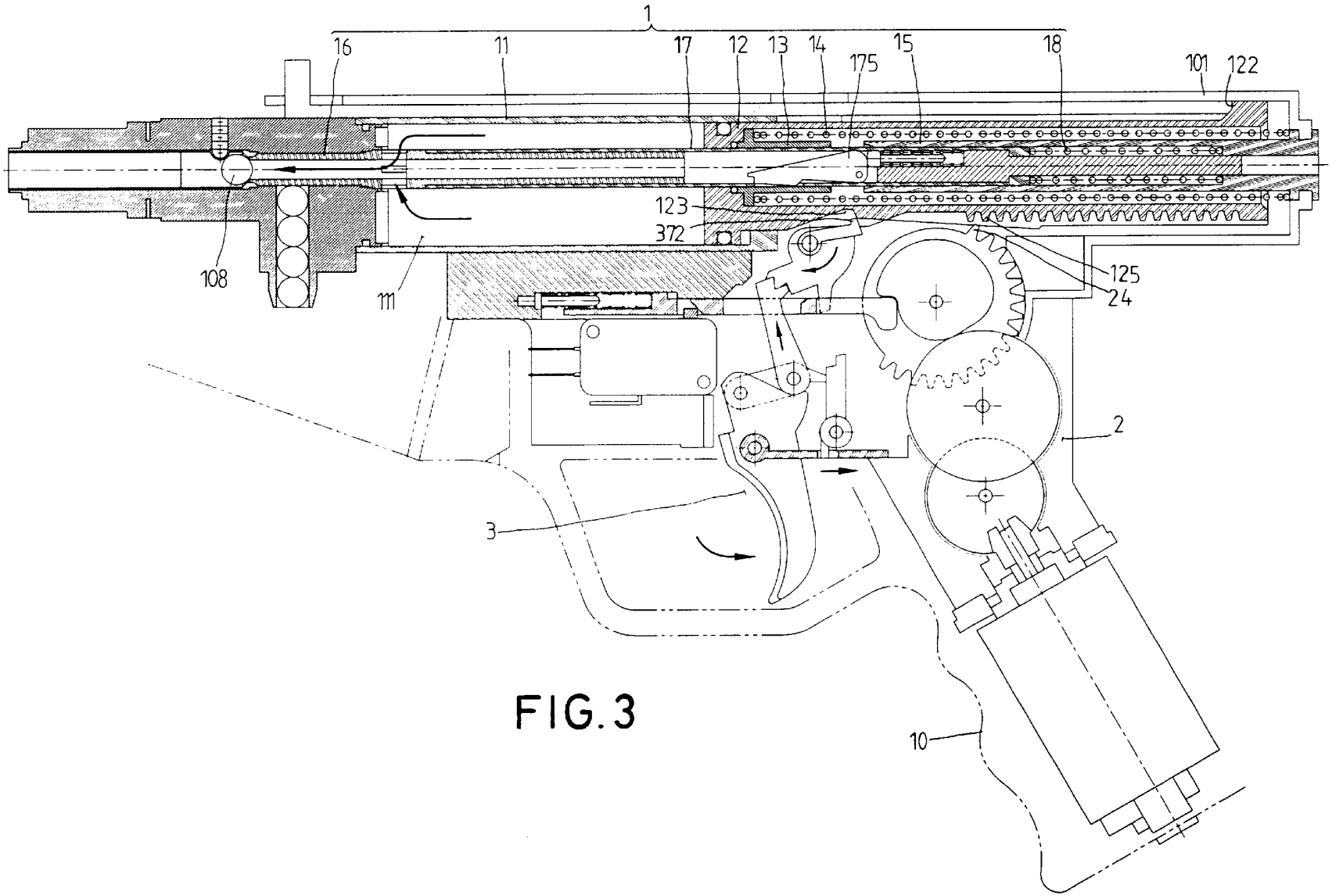
FIG. 3 is a schematic operational view of the motorized toy gun as shown in FIG. 2 in use.
Figures 1, 3:
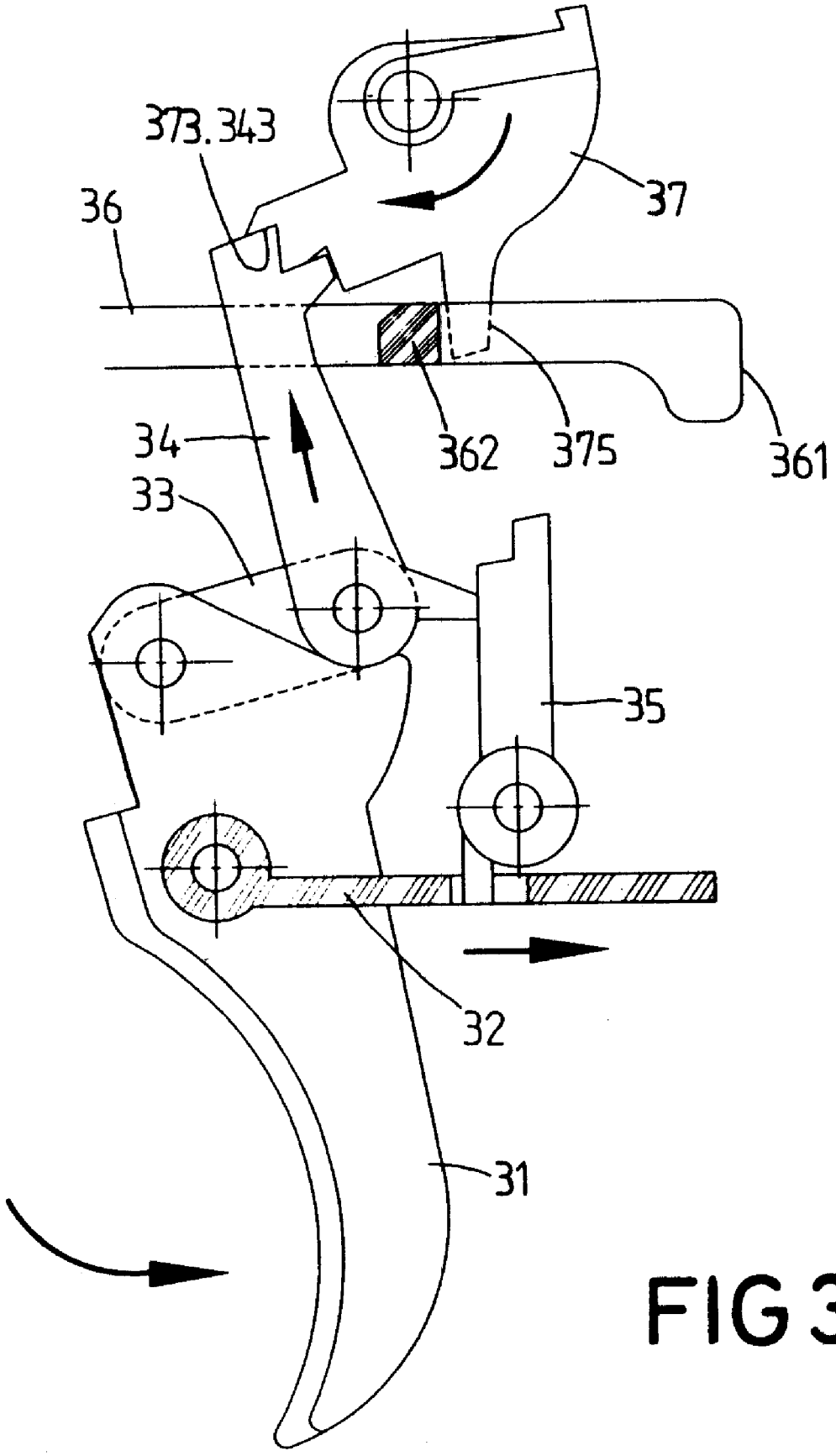

As shown in FIGS. 3 and 3-1, when the trigger 31 is pressed, the upper resting block 342 and side resting block 343 of the lift member 34 may push the first driven portion 373 and second driven portion 374 of the locking member 37 upward, so that the locking member 37 may be rotated clockwise, thereby detaching the locking lug 372 of the locking member 37 from the locking recess 123 of the piston cylinder 12.

Figure 4:
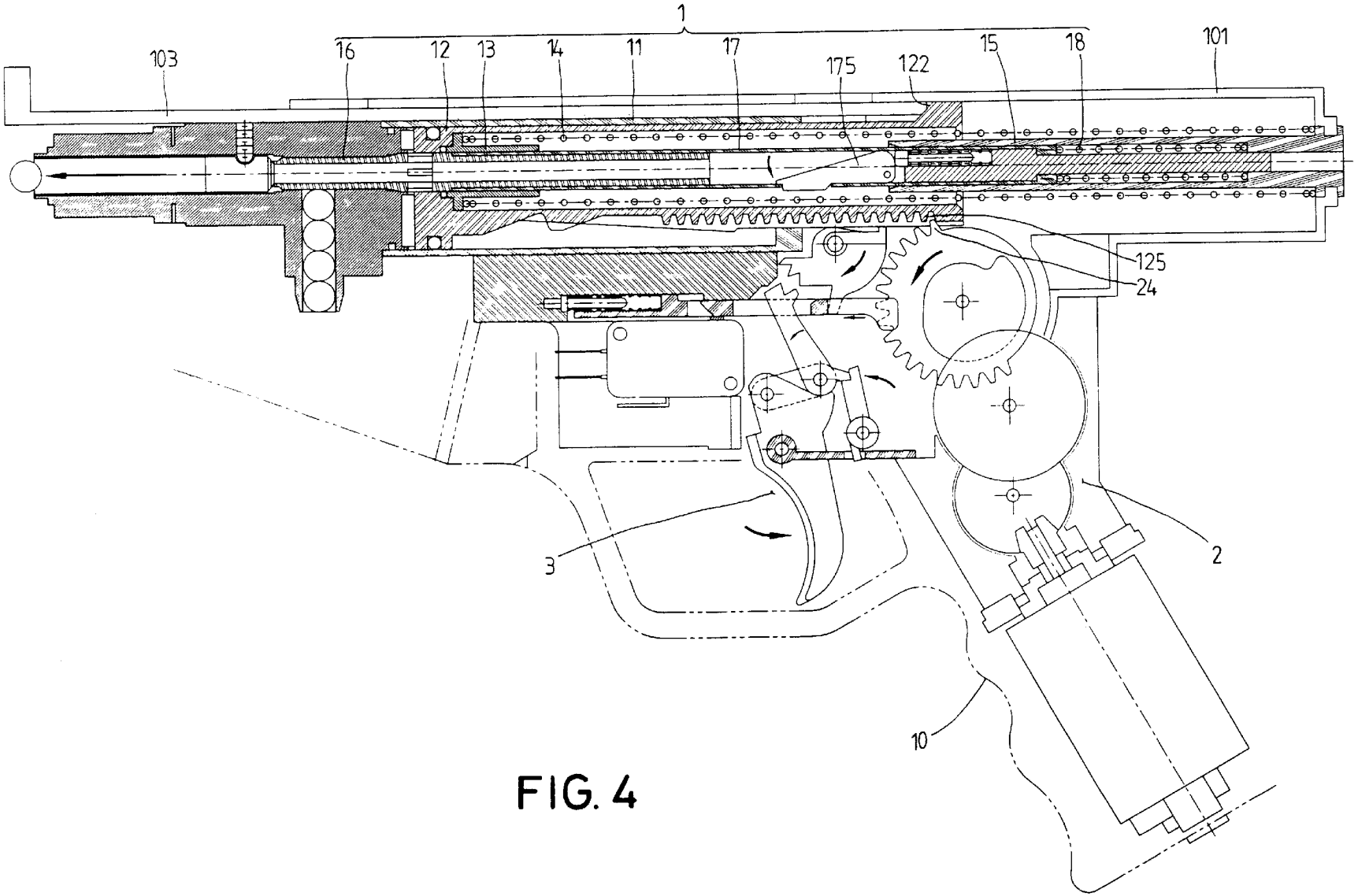
FIG. 4 is a schematic operational view of the motorized toy gun as shown in FIG. 3 in use.
Figures 1, 4:
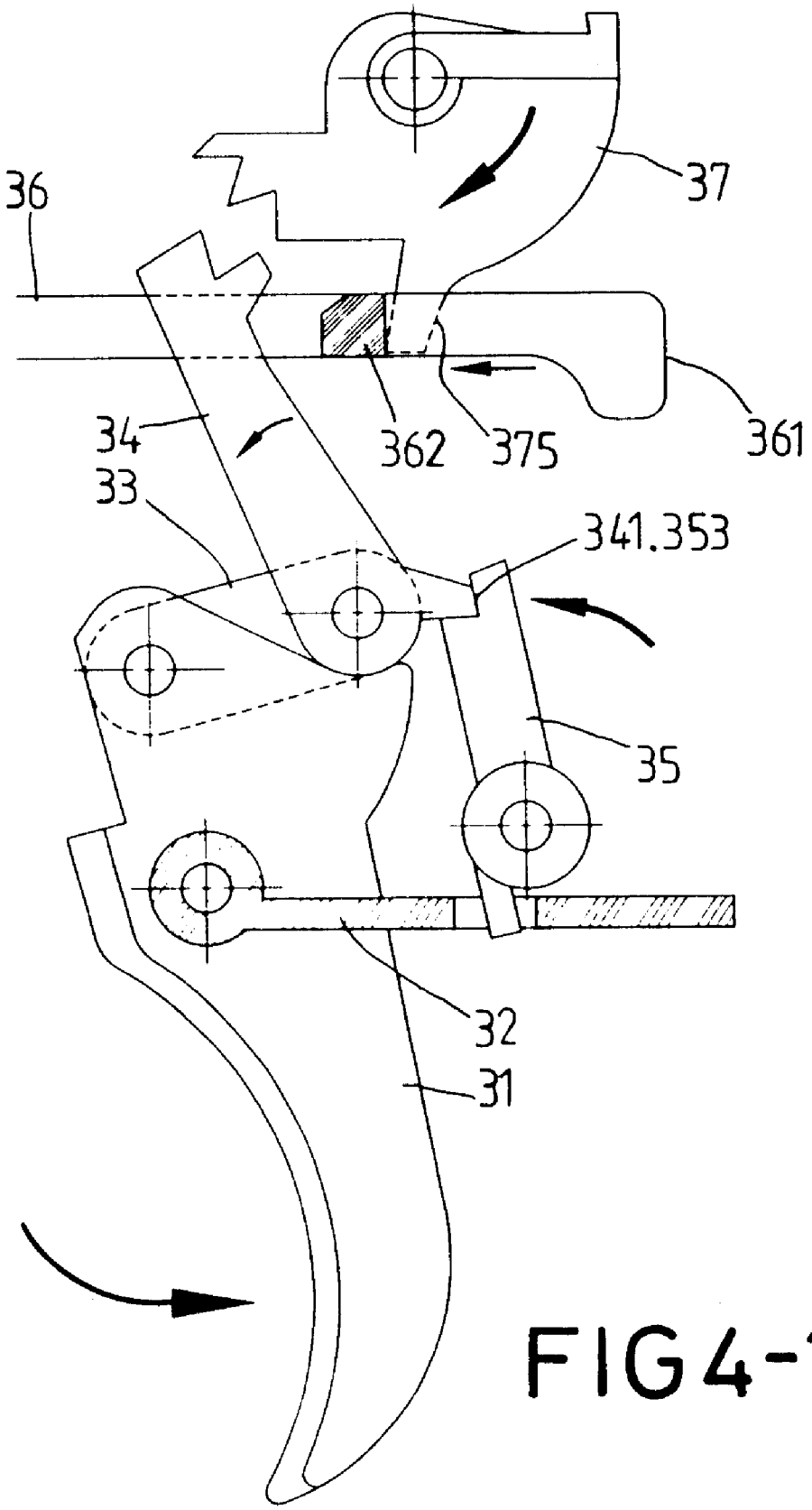

At this time, the drive block 375 is moved with the clockwise rotated locking member 37 to push and move the push action block 362 of the switch arm 36 toward the front portion of the gun body 10 as shown in FIGS. 4 and 4-1, so that the press button 381 of the microswitch 38 may be pressed by the inclined press face 363 of the switch arm 36, thereby opening the microswitch 38 which may start and operate the motor 21 which may counterclockwise rotate the force output gear 24 which meshes with and moves the rack 125 of the piston cylinder 12, so as to move the piston cylinder 12 forward, thereby increasing the pressure in the cylinder 12. Thus, the forward movement of the piston cylinder 12 may be accelerated by the restoring force of the piston spring 14 and by the power provided by the force output gear 24 co-operating with the rack 125, whereby the BB bullet 108 located in the bullet feeding chamber 105 may be pushed forward by the pressure caused by the forward movement of the piston cylinder 12, so that the BB bullet 108 may be ejected outward.

Figure 5:
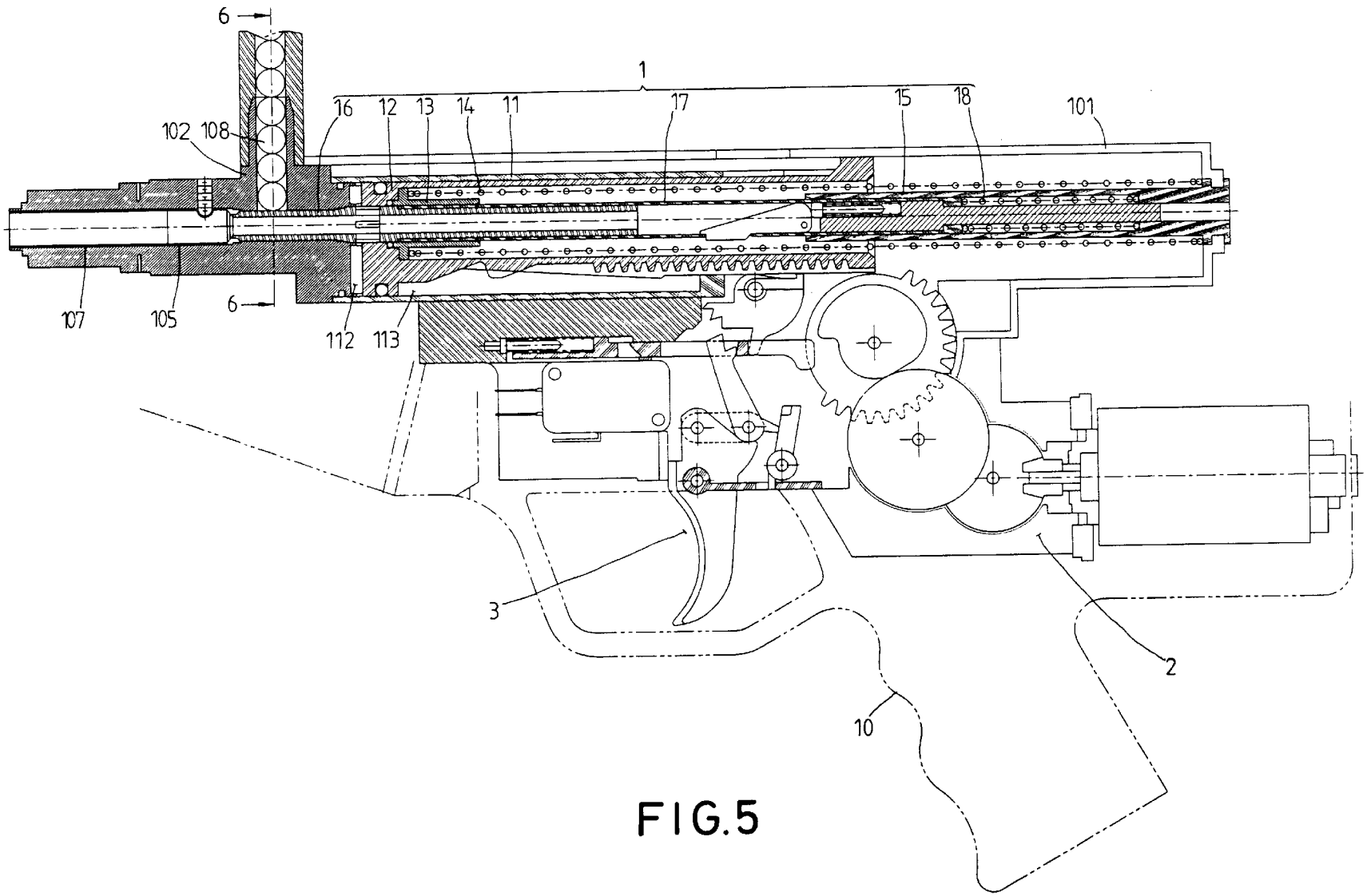
FIG. 5 is a front plan cross-sectional assembly view of a motorized toy gun in accordance with a second embodiment of the present invention.
Figure 6:
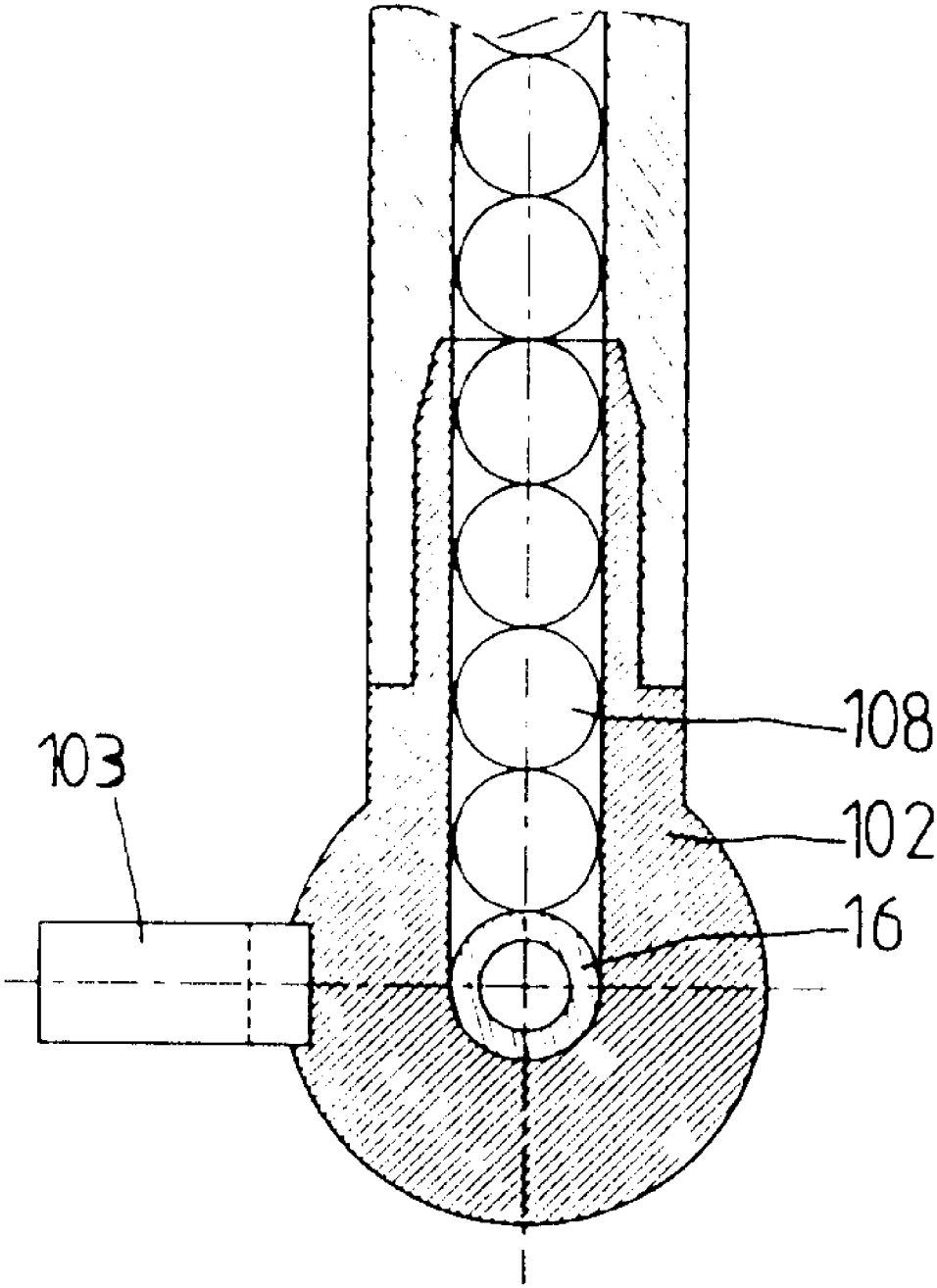
FIG. 6 is a cross-sectional view of the motorized toy gun taken along line 6—6 as shown in FIG. 5.

Referring to FIGS. 5 and 6, the BB bullet supply portion 102 of the BB bullet feeding device 1 of a toy gun in accordance with a second embodiment of the present invention is mounted on the top of the barrel 101, and the cocking handle 103 is mounted on a side of the BB bullet supply portion 102.

Accordingly, the BB bullet feeding device of a toy gun in accordance with the present invention has the following advantages.

1. The horizontal forward movement of the piston cylinder 12 may be accelerated by the restoring force of the piston spring 14 and by the power provided by the force output gear 24 co-operating with the rack 125, thereby greatly increasing the pressure in the cylinder 11, so that the BB bullet 108 may be ejected outward quickly and conveniently.

2. The locking lug 372 of the locking member 37 may be locked with the locking recess 123 of the piston cylinder 12, so that the force output gear 24 and the rack 125 will not bear any load at a normal state, thereby saving the power source.

3. The piston cylinder 12 may be moved in the cylinder 11 freely, the force output gear 24 may mesh with and detach from the rack 125 easily, and the microswitch 38 may be opened by the switch arm 36.

4. The force output gear 24 will not mesh with the rack 125 in a normal state, thereby decreasing the load of the motor 21, and thereby increasing the lifetime of the toy gun.

5. As shown in FIG. 4-1, the trigger 31 may be pressed continuously, whereby the resting block insertion recess 353 of the connecting arm 35 is rested on the connecting arm resting block 341 of the lift member 34, so that the switch arm 36 may connect the electric power successively, so that the BB bullet 108 may be ejected outward continuously.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A motorized toy gun, comprising: a gun body provided with a barrel having an inner portion provided with a bullet feeding device that may be moved and operated horizontally, the barrel of the gun body having a lower portion provided with a power set and a trigger operation set, and having a front end provided with a BB bullet supply portion which has a center formed with a transverse hole, a cocking handle mounted on an upper portion of the BB bullet supply portion to move horizontally, the transverse hole of the BB bullet supply portion having a mediate section provided with a bullet feeding chamber whose inner portion is provided with a pressure applying portion, and a front section provided with a bullet outlet tube;

the bullet feeding device including a cylinder, a piston cylinder, a front spring guide tube, a piston spring, a rear spring guide tube, a nozzle, a sealing tube, and a bullet feeding spring;

the power set including a motor, a first drive gear, a second drive gear, and a force output gear, wherein:

the piston cylinder has an outer wall having a lower portion formed with a locking recess, an inclined path beside the locking recess, and a rack beside the inclined path;

the force output gear of the power set has multiple teeth arranged in a sector shape, and has a center provided with an idler which has an insertion recess;

the trigger operation set includes a trigger, a connecting arm push plate, a trigger arm, a lift member, a connecting arm, a switch arm, a locking member, and a microswitch;

the trigger has a top end having a first side pivoted with a front end of the trigger arm, and a second side formed with an arcuate recess, the trigger has a mediate section pivoted with a front end of the connecting arm push plate, the connecting arm push plate has a mediate section formed with a lug insertion hole, the trigger arm has a rear end pivoted with a lower end of the lift member, the lower end of the lift member has an arcuate portion received in the arcuate recess of the trigger, the lower end of the lift member has a wall protruded with a connecting arm resting block, the lift member has an upper end provided with an upper resting block and a side resting block, the connecting arm has a lower end pivoted above the connecting arm push plate, and provided with a lug that may be inserted into the lug insertion hole of the connecting arm push plate, the connecting arm has an upper end formed with a resting block insertion recess for receiving the connecting arm resting block of the lift member, the switch arm may be moved horizontally, and has a rear end provided with an idler push portion, a mediate section provided with a push action block, and a front end provided with an inclined press face, the microswitch is mounted under the front end of the switch arm, and includes a press button that may be pressed by the inclined press face of the switch arm, the locking member is pivoted above the push action block of the switch arm, and has an upper end provided with a locking lug, a side portion provided with a first driven portion and a second driven portion, and a lower end provided with a drive block.

2. The motorized toy gun in accordance with claim 1, wherein the first side of the top end of the trigger is pivoted with the front end of the trigger arm by a pivot axle.

3. The motorized toy gun in accordance with claim 1, wherein the mediate section of the trigger is pivoted with the front end of the connecting arm push plate by a pivot axle.

4. The motorized toy gun in accordance with claim 1, wherein the rear end of the trigger arm is pivoted with the lower end of the lift member by a pivot axle.

5. The motorized toy gun in accordance with claim 1, wherein the lower end of the connecting arm is pivoted above the connecting arm push plate by a pivot axle.

6. The motorized toy gun in accordance with claim 1, wherein the front end of the switch arm is formed with a receiving recess for receiving a push arm spring and a mounting rod.

7. The motorized toy gun in accordance with claim 1, wherein the locking member is pivoted above the push action block of the switch arm by a pivot axle.

8. The motorized toy gun in accordance with claim 1, wherein the BB bullet supply portion is mounted on a top of the barrel, and the cocking handle is mounted on a side of the BB bullet supply portion.

* * * * *